United States Patent [19]

Evers

[11] 4,279,608

[45] Jul. 21, 1981

[54] BAG BOTTOM FORMING MACHINE AND TRANSFER APPARATUS

[75] Inventor: Jack R. Evers, Torrance, Calif.

[73] Assignee: Developak Corporation, Redondo Beach, Calif.

[21] Appl. No.: 76,447

[22] Filed: Sep. 17, 1979

[51] Int. Cl.[3] ..... B31B 1/32

[52] U.S. Cl. ..... 493/247; 493/250; 493/472; 493/477

[58] Field of Search ..... 93/12 R, 12 C, 10, 8 R, 93/35 SB, 36.8, 39.1 R, 39.2, 39.3, 44.1 R, 44

[56] References Cited

U.S. PATENT DOCUMENTS

| | | | |
|---|---|---|---|
| Re. 26656 | 9/1969 | Guzzardo | 93/44.1 R X |
| 2,257,689 | 9/1941 | Jungmayr | 93/44.1 R X |
| 3,079,845 | 3/1963 | Powell | 93/44.1 R |
| 3,334,551 | 8/1967 | Cawley | 93/44.1 R X |
| 3,432,986 | 3/1969 | Schneider et al. | 93/44.1 R X |
| 3,464,326 | 9/1969 | Egleston | 93/44.1 R |

*Primary Examiner*—James F. Coan
*Attorney, Agent, or Firm*—Charles E. Brown

[57] ABSTRACT

This relates to a bag forming machine wherein a continuous tube is formed from a contuous web, the tube having a side seam and being cut off at predetermined intervals to form short tubes with closed bottoms. The tubes are placed on mandrel assemblies of a turret and the mandrel assemblies, as the turret is indexed, are actuated so as to axially elongate the closed tubes while holding the open end of each tube against movement, thereby generally forming a flat bottom on the tube and triangular bottom portions. The turret is next indexed so as to plow down the triangular bottom portions flat against the flat bottom portion followed by further indexing of the turret to heat seal the triangular positions to the flat bottom portion and then cool the heat seals. Finally, each closed bottom bag is gripped by a combined rotator and orientation device wherein the side seam of the bag is rotated to a selected orientation. The flat bottom bag is then transferred from the turret into a pocket of a conveyor which directs the bag to a filler and then a heat sealer for closing the closed bag. In order to effect the transfer of the bag from the turret, it is necessary that an outer mandrel of each mandrel assembly be projected radially from the turret a considerable distance. This is effected by way of a plunger carrying the mandrel and an associated cam. The cam has a sector thereof which is radially movable relative to the remainder of the cam by a rocker arm which is actuated in timed relation to the indexing of the turret so as to provide for the necessary outer mandrel travel.

20 Claims, 16 Drawing Figures

106
11
198
168
176
172
216
68
174
104
188
72
198
214
210
206
208
220
200
222
224
8
9

170
54
168
204
64
26
86
188
42
174
172
220
84
88
78
188
202
200
128
206
216
68
106
208
172
188
42
88
72
188
198
220

FIG. 9
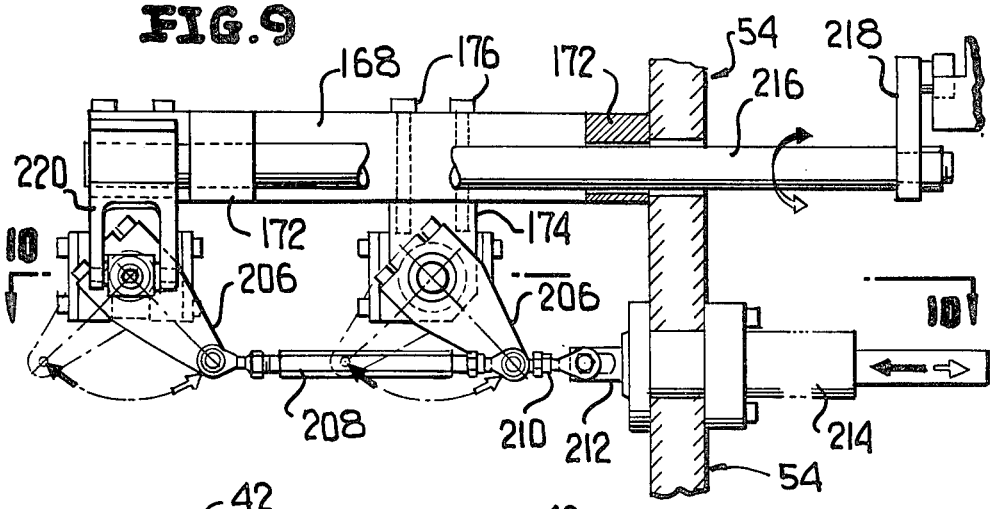
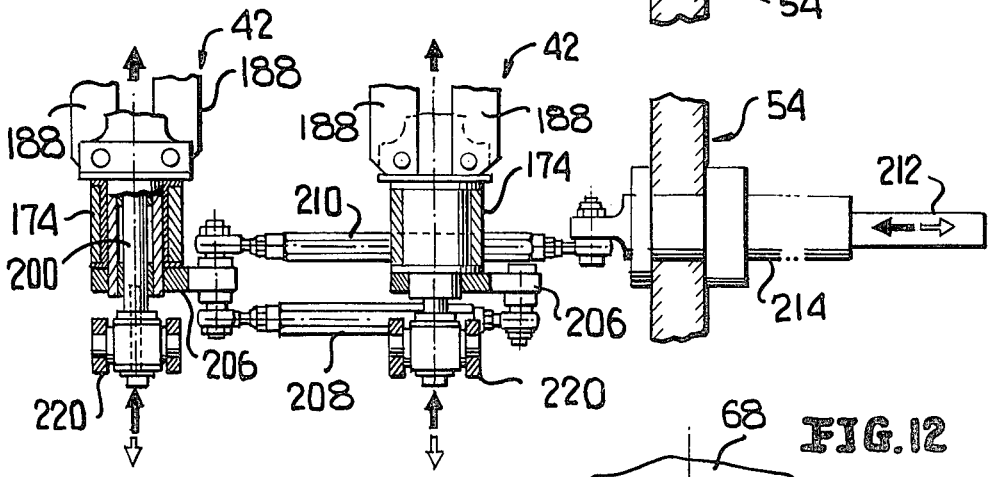
FIG. 10
FIG. 11
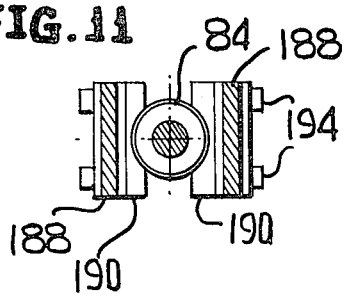
FIG. 12
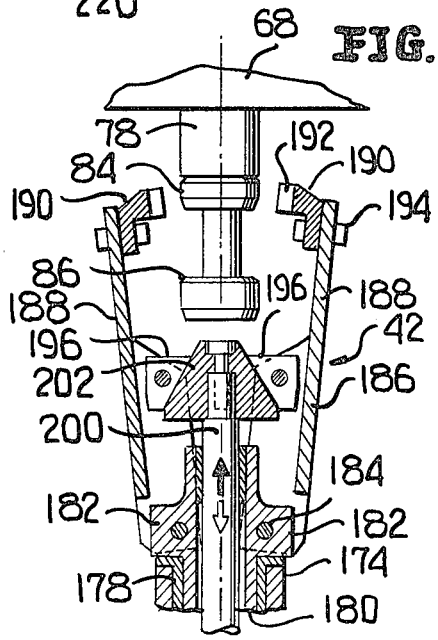

BAG BOTTOM FORMING MACHINE AND TRANSFER APPARATUS

This invention relates in general to new and useful improvements in bag forming machines, and more particularly to the forming of small size bags for the reception of a small amount of a product, for example bags receiving products in the one to four ounce range.

Most specifically, this invention has to do with the forming of the bottom of a bag of the type specifically disclosed in the patent to William S. Schneider, U.S. Pat. No. 3,432,986 granted Mar. 18, 1969.

The machine of this invention provides a continuous web which is shaped into a tubular form with the side edges of the web being in face to face relation. The side edges are then heat bonded together with the edges being in an upstanding position. Thereafter the tube is cut to the desired length and formed with a transverse bottom seal which extends substantially at right angles to the plane of the side seam.

This invention particularly relates to a turrent and mandrel assembly for receiving such a cut off and bottom sealed length of tube, forming the bottom into a square bottom which makes the resultant bag self-standing, then orienting the side seam for a final closing seal, followed by the transfer of the so formed bag from the turret to a take-away conveyor for filling and later sealing.

Most specifically, this invention relates to a turret arrangement which has a plurality of stations and wherein at each station the turret is provided with an inner mandrel which is mounted for rotation only and an outer mandrel which is carried by a suitable support or plunger for radial outward movement relative to the inner mandrel whereby when the closed length of tube is telescoped over the two mandrels, and the tube is clamped adjacent its open mouth to a mandrel part followed by the radial outward movement of the outer mandrel, the bottom of the tube is squared up leaving two generally triangular flaps which are to be sealed in place.

One of the specific features of the invention is the provision of clamp means which automatically clamp the mouth portion of the tube to a mandrel part, the clamp means including pivotally mounted clamps, the position of which are controlled by mounting rods one of which is axially movable so as to shift the clamp elements from clamping positions to release positions.

Another feature of the invention is the mounting of plow means adjacent the path of movement of the outer mandrels thereby once the bottom of the bag has been generally squared and the triangular bottom portions formed, movement of the turret will result in the triangular portions being plowed to a flattened condition overlying the generally flat bottom.

The turret is also provided with means for first heat sealing the triangular portions to the flat bottom, followed by the cooling of the bottom. In order to make certain that the heat sealing is complete, there is a second bottom sealing operation followed by a further cooling action.

The shaped bag including its flat bottom is now carried by the turret with the side seam disposed lowermost so that when the bag is eventually discharged from the turret, the side seam would normally be disposed in the plane of movement of the bags toward a filling operation. This orientation is incorrect for the proper closing of the bag. Accordingly, the turret has associated therewith bag rotating means which rotate the bag ninety degrees so as to properly orient the side seam when it is placed in a take-away conveyor.

A further feature of the invention is the provision of a cam for actuating the support or plunger for the outer mandrels. While the cam can have the required stroke so as to effect the projection and retraction of the outer mandrel as is necessary to stretch the tube and square the bottom, because the cam is generally mounted within the confines of the turret assembly, it is not possible for the cam to have sufficient stroke so as to effect the radial outward movement of the outer mandrels at a discharge station sufficiently to effect the complete transfer of the square bottom bags. Accordingly, there has been provided a novel cam assembly wherein a lowermost segment of the cam is radially displaceable whereby in lieu of the cam camming cam follower carried by the plunger or support for the outer mandrel, the entire cam segment is, upon each indexing of the turret, moved radially away from the center of the turret so as to effect a projection of the outer mandrel greater than that possible with the cam configuration.

In accordance with the invention, the segment of the cam is carried by a rocker arm which is pivotally mounted and, when actuated, serves to move the cam segment a considerable distance.

Another feature of the invention is the mounting of the turret and the various bottom shaping and bag rotating apparatus on the front side of a main wall of the machine while the drive mechanism is disposed on the opposite side thereof so that a sanitary machine is provided with all the operating mechanism being on the reverse side of the main wall. This main wall is of a sandwich construction and includes two relatively thick plates which are spaced apart and joined by ribs and stringers so as to form a generally honey comb structure thereby providing an adequate support structure which at the same time functions as a divider wall.

With the above, and other objects in view that will hereinafter appear, the nature of the invention will be more clearly understood by reference to the following detailed description, the appended claims and the several views illustrated in the accompanying drawings.

FIG. 9 is an enlarged fragmentary generally vertical sectional view taken generally along the line 9—9 of FIG. 7 and shows specifically the operating mechanism for controlling the position of clamping jaws and effecting rotation of the clamping jaws.

FIG. 10 is a fragmentary generally horizontal sectional view taken along the line 10—10 of FIG. 9 and shows further the drive mechanism for the bag rotating means.

FIG. 11 is an enlarged fragmentary generally vertical sectional view taken alone the line 11—11 of FIG. 7 and specifically shows the details of the clamp mechanism for clamping the bag to effect rotation thereof.

FIG. 12 is an enlarged fragmentary sectional view taken longitudinally of one of the bag rotating devices and shows the specific details thereof in its open position.

Figure 1:
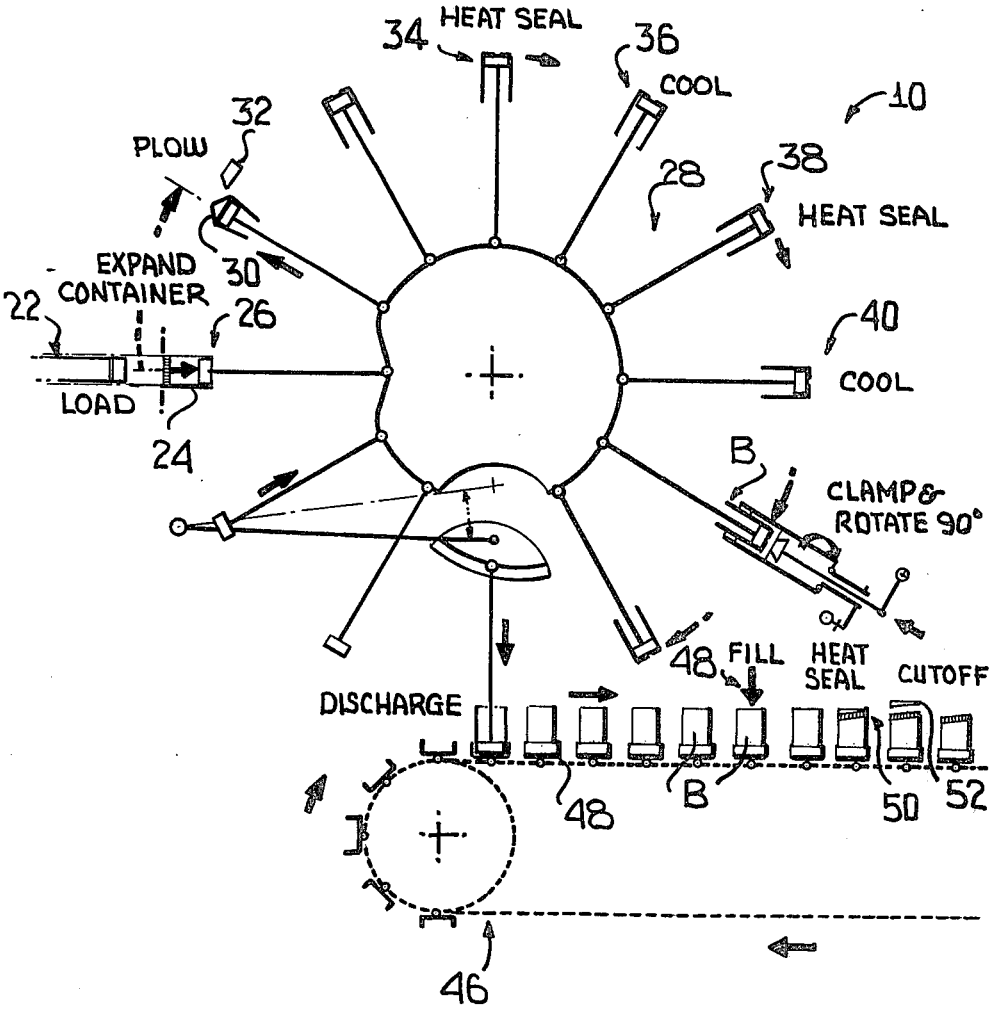
FIG. 1 is a schematic elevational view showing the general operation of the turret in accordance with this invention.

Referring now to the drawings in detail, reference is made first to FIG. 1 where there is schematically illustrated the operation of that portion of the machine to which this invention relates. The machine is generally identified by the numeral 20 and includes a mechanism 22, which per se is not a part of this invention. The mechanism 22 forms in step by step movements from a continuous web a continuous tube with an upstanding side seam. The tube is then cut at lengths and sealed together on a horizontal plane to form a closed end tube 24. This tube is placed on a mandrel assembly 26 of one station of a plural station turret, generally identified by the numeral 28. This occurs at the nine o'clock position of the turret in the illustrated embodiment of the invention.

The turret turns in a clockwise direction and immediately after the turret begins indexing, the mouth portion of the tube 24 is gripped so as to be radially restrained, and the mandrel assembly 26 serves to radially stretch the clamped tube, thereby partially forming the sealed end thereof into a generally flat bottom having a pair of upstanding triangular portions 30 at opposite sides of the flat bottom portion. Such a partially formed bag bottom is disclosed in the aforementioned Schneider U.S. Pat. No. 3,432,986. As the turret is next indexed, the triangular bottom portions 30 are flattened downwardly against the generally flat bottom by means of suitable plow means 32.

The tube 24, which has now generally become a bag, has the triangular bottom portions 30 heat sealed to the generally flat bottom portion at the twelve o'clock position by means of a heat sealer 34. At the one o'clock position, the heat sealed bag bottom is cooled by a cooling device 36. Then at the two o'clock position, the heat sealed bottom is further heat sealed by a second heat sealer 38. When the turret next indexes, at the three o'clock position, the heat sealed bag bottom is again cooled by a cooler 40.

The resultant bag B is then engaged at the four o'clock position by a bag rotating and orienting mechanism 42.

The oriented bag is then moved to the six o'clock position wherein it is discharged from the turret 28 into an aligned pocket 44 of a take-away conveyor 46.

The formed bags B, as is schematically illustrated in FIG. 1, are filled with a suitable product by means of a filler 48 after which the upper opened mouth of the bag is heat sealed closed along a sloping line by a heat sealer 50. The bag B above the heat seal formed by the heat sealer 50 is cut away to define scrap 52 which is drawn up into a vacuum receiver (not shown).

It is to be first of all understood that although only a portion of the machine 20 has been illustrated, the machine 20 is basically divided into a sanitary half and a machinery half by an upstanding wall 54. The wall 54 also functions as the support structure for the various components of the machine. The wall 54 is of a generally honey comb construction and includes an outer plate 56 and an inner plate 58 which are separated by ribs and stringers of which only the stringers 60 are shown. It is to be understood that the wall 50 is of a very high structural strength while at the same time being relatively light in weight.

Figure 5:
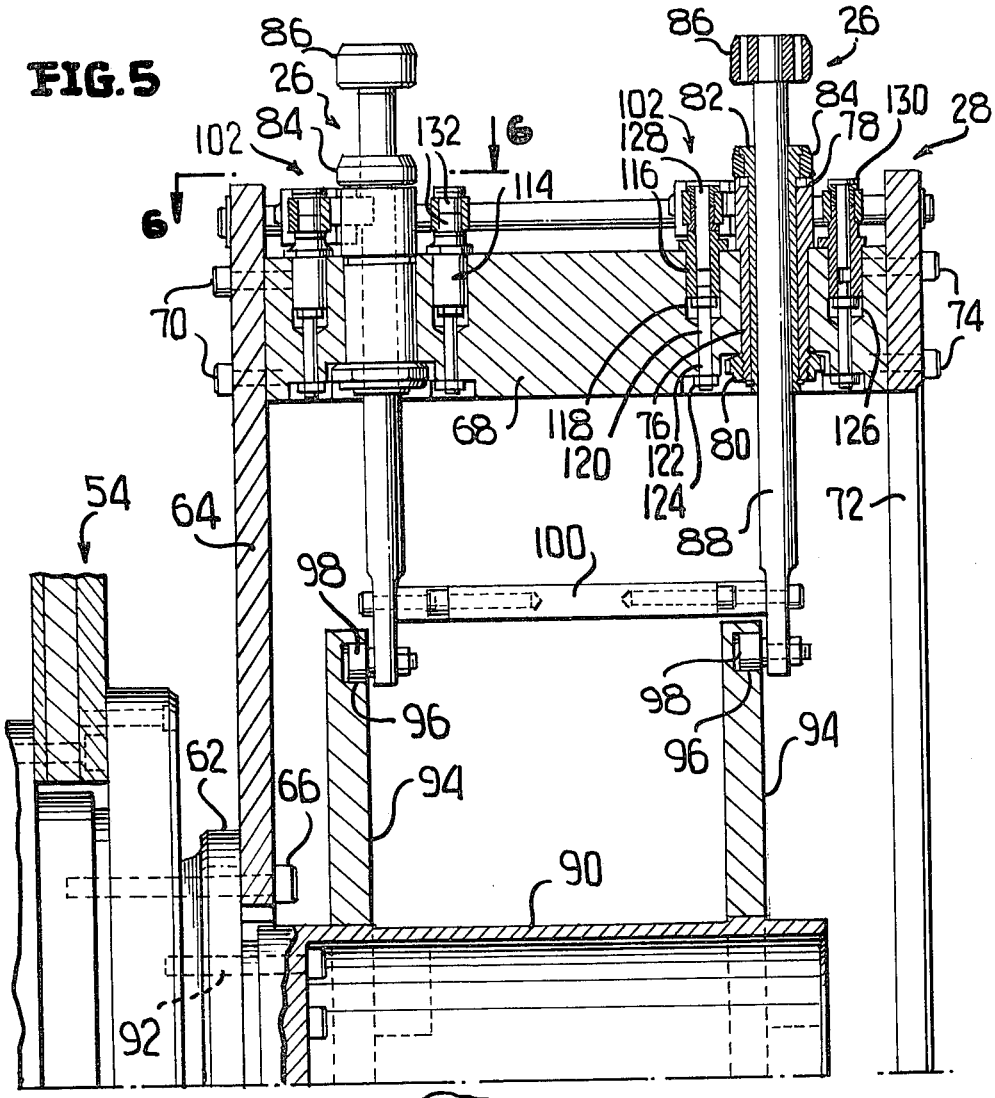
FIG. 5 is an enlarged fragmentary vertical sectional view taken longitudinally on the axis of the turret and shows specifically the mounting of the mandrels and the supports for the outer mandrels.

Referring now to FIG. 5 in particular, it will be seen that the turret 28 includes a driving flange 62 which is rotatably journaled relative to the wall 54 and which is periodically indexed one station by a conventional indexing drive mechanism (not shown). The drive flange 62 has removably bolted thereto a rear plate 64 of the turret 28 by means of suitable bolts 66.

Figure 2:
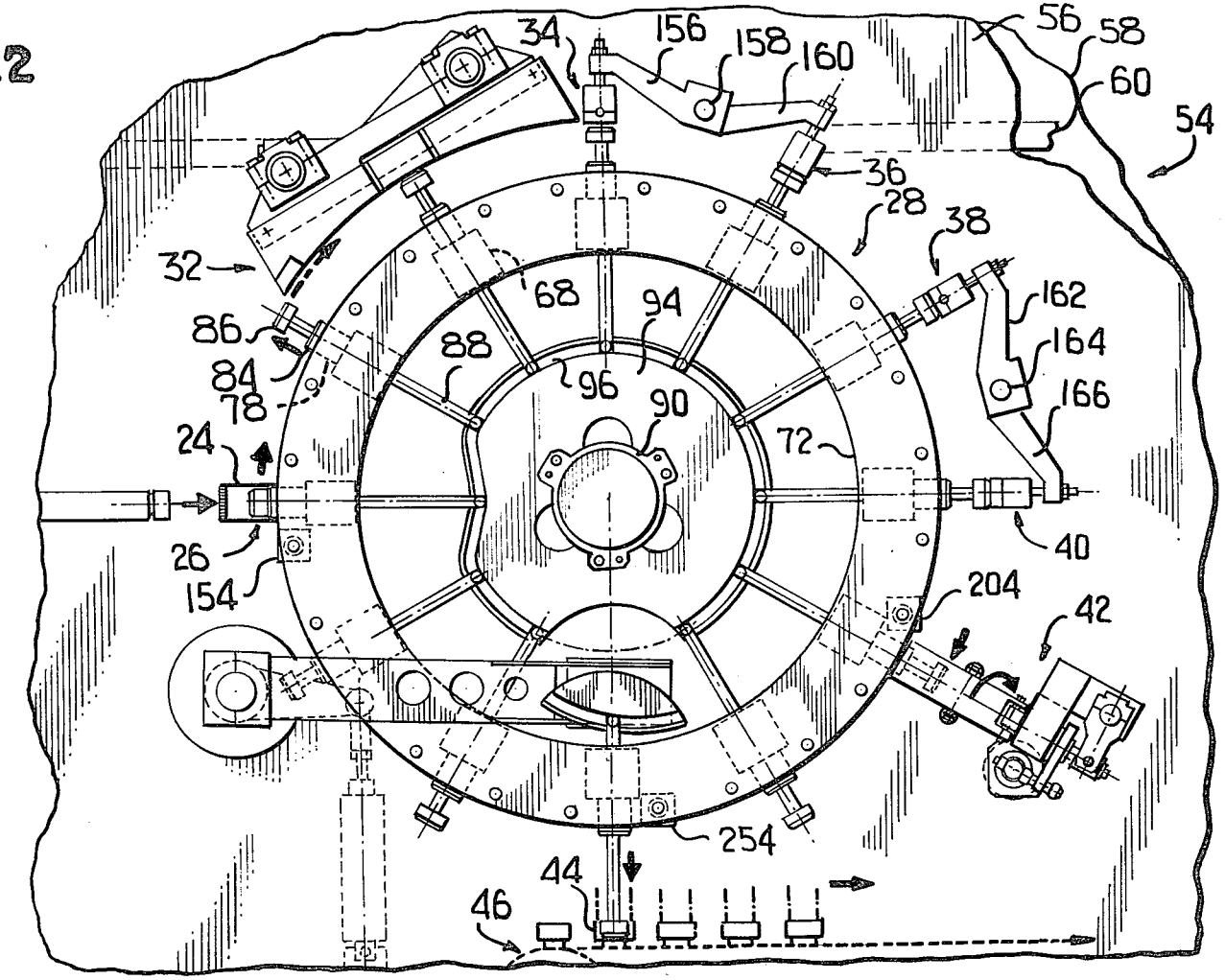
FIG. 2 is a fragmentary elevational view of the turret arrangement of FIG. 1, with parts omitted for purposes of clarity and shows more specifically the details of the turret assembly.

As is best shown in FIG. 2, in the preferred embodiment of the invention, the turret 28 has twelve stations. At each of the stations there is a spacer block 68 which is rigidly secured to the front face of the plate 64 by bolts 70. The front ends of the spacer block 68 are joined together by an annular front plate 72 which is secured to the front end of the spacer block 68 by bolts 74.

As is best illustrated in FIG. 5, at each station of the turret assembly 28, there are two mandrel assemblies 26, the machine 20 being constructed to form two tubes 24 and to present two closed end tubes 24 to the turret upon each indexing thereof.

As is best illustrated in FIG. 5, each mandrel assembly 26 includes a bore 76 radially through the spacer block 68. Clamped in the bore 76 is a stepped sleeve 78 which has an externally threaded inner end having threadedly engaged thereon a locking nut 80 which clamps the sleeve 78 in place.

The sleeve 78 has rotatably journaled therein a further stepped sleeve 82 which carries for rotation therewith a inner mandrel 84.

Each mandrel assembly 26 also includes an outer mandrel 86 which is carried by an elongated support or plunger 88 on which the mandrel 86 is mounted for rotation and with which the mandrel 86 is radially displaceable relative to the inner mandrel 84. It is to be noted that the plunger 88 is slidably journaled with the sleeve 82.

As is also best illustrated in FIG. 5, the turret assembly 28 includes a drum shaft 90 which is secured to the driving flange 62 by bolts 92 for rotation with the flange. The drum 90 has fixedly secured thereto a pair of cams 94 each of which defines a cam track 96 in which there is positioned a cam follower 98 carried by the inner end of a respective one of the plungers 88. In order to provide a rigid structure and to assure alignment of the cam followers 98 in the respective cam tracks 96, inner end portions of the plungers 88 are joined together by a spacer bar 100.

Figures 3, 4:
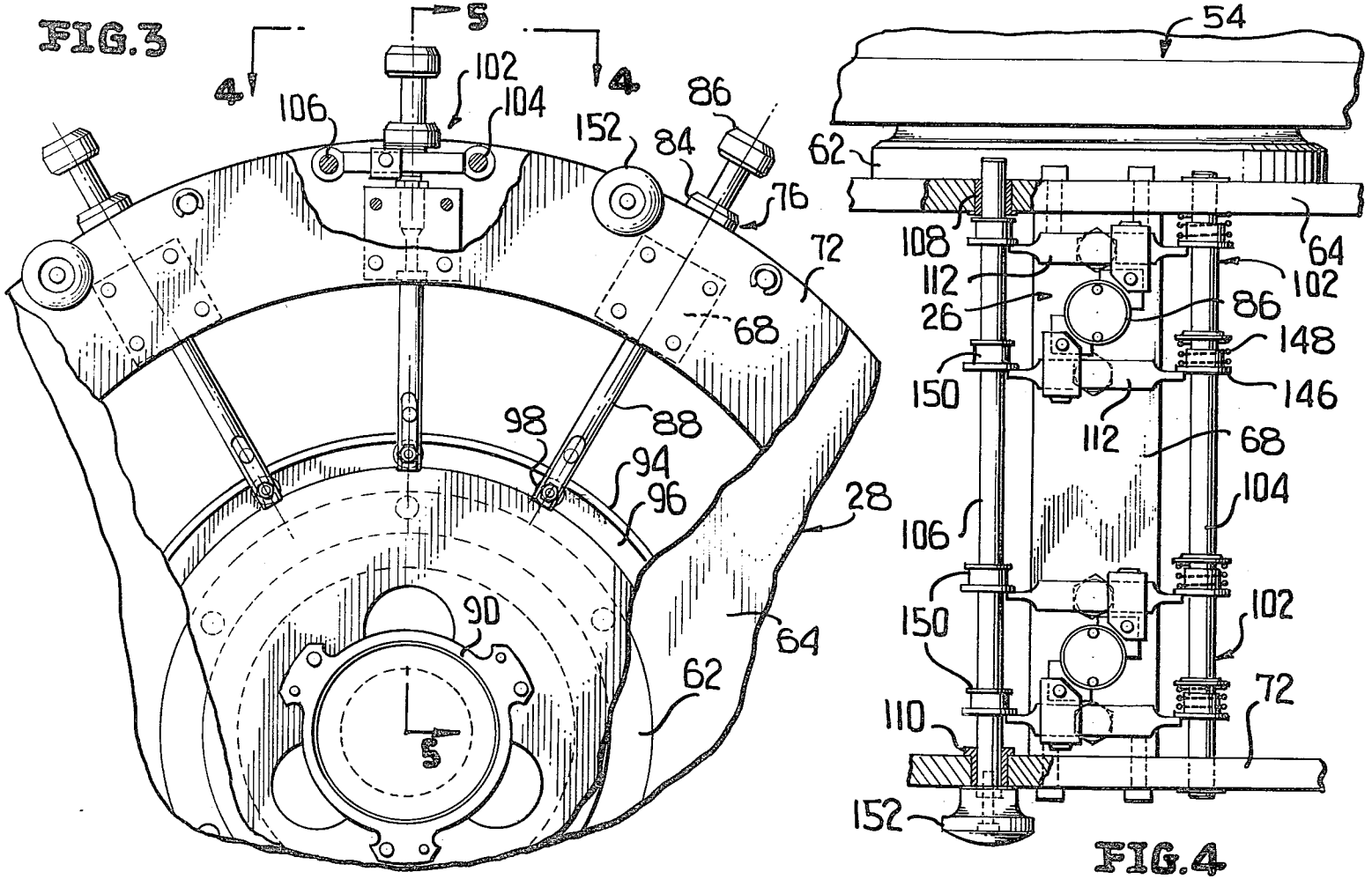
FIG. 3 is a enlarged fragmentary elevational view with parts broken away and showing generally the mounting of mandrels and clamp means associated therewith.
FIG. 4 is an enlarged fragmentary plan view taken generally along the line 4—4 of FIG. 3 and shows specifically the details of the clamp means associated with the inner mandrels of the turret.
Figure 6:
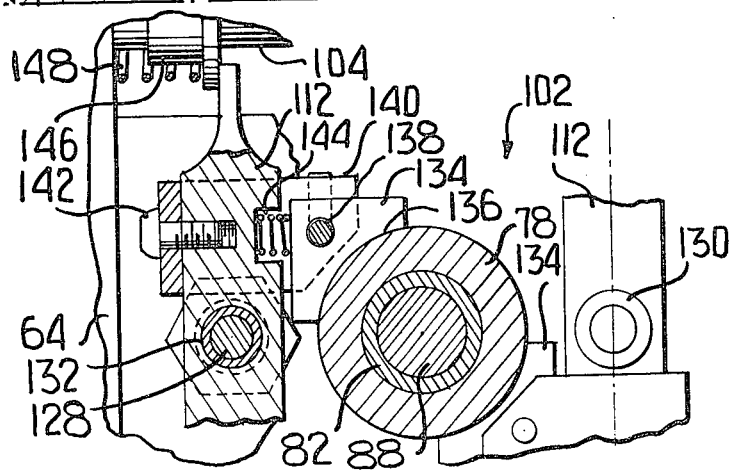
FIG. 6 is an enlarged fragmentary sectional view taken generally along the line 6—6 of FIG. 5 and most specifically shows the manner in which clamp elements are associated with a sleeve disposed adjacent the inner mandrels to clamp the mouth portions of the bags in a fixed relation with respect to the inner mandrels.

Referring now to FIGS. 4 and 6, it will be seen that associated with each of the mandrel assemblies 26 is a clamp assembly, generally identified by the numeral 102. The two adjacent clamp assemblies 102 are in part carried by the associated spacer block 68 and in part by a pair of rods 104, 106 which extend between the plates 64, 72 with the rod 104 being fixed and the rod 106 being slidable relative to the plates. To this end, the rod 106 is slidably journaled in bushings 108, 110 carried by the plates 64, 72, respectively.

Each clamp assembly 102 includes a pair of clamp arms 112 which are identical but which are mounted in right and left relation. Each clamp arm 112 has the central portion thereof mounted on a pivot shaft assembly 114 which extends through an associated bore in the spacer block 68. As is best shown in FIG. 5, each pivot shaft assembly 114 includes a flanged sleeve 116 which is seated in a large diameter outer bore portion 118. The inner end of the sleeve 116 has threaded therein a stud 120 which extends through a reduced diameter bore portion 122 and is provided with a securing nut 124 on an inner end thereof. The stud 120 also carries a lock nut 126.

The sleeve, in turn, carries a pivot stud 128 which has an enlarged head 130. Each pivot stud 128 carries half bushings 132 which are received within the associated clamp arm 112.

Each clamp arm 112 carries a clamp block 134 having an arcuate clamping surface 136 which corresponds to the outer surface of the sleeve 78. Each clamp block 136 is pivotally mounted on a pivot pin 138 which is carried by a U-shaped bracket 140 which is fixedly secured to an adjacent end portion of the clamp arm 112 by means of a fastener 142. A spring 144 normally centers the clamp block 134.

Each end of each clamp arm or lever 112 is of reduced thickness. Associated with a respective end of each clamp arm 112 and carried by the rod or shaft 104 is a flanged sleeve 146 which is urged towards the clamp arm by a spring 148. The opposite end of each clamp arm 112 is engaged by a flanged sleeve 150 which is fixedly mounted on the shaft or rod 106.

It will be readily apparent from FIGS. 4 and 6 that the clamp assemblies 102 are spring loaded so as to normally urge the clamp locks 134 against the radial outer end of the sleeve 78. However, since the rod 106 is axially movable, when moved to the front, as viewed in FIG. 4, the flanged sleeves 150 will pivot the clamp arms 112 to release positions. Suitable cam means, to be described hereinafter, urge the clamp assemblies 102 to release the conditions at preselected points. In order that the clamp assemblies 102 may be manually released, the front end of each of the rods 106 is provided with a grip button 152.

Referring once again to FIGS. 1 and 2, it will be seen that when one of the stations of the turret 28 is indexed to the nine o'clock position, the rod 106 has the rear end thereof engaged with a release cam 154. At this time, the closed end tube 24 is forced onto the mandrel assembly 26 with the tube being telescoped over the mandrels 86 and 84 and over the outer portion of the sleeve 78. With the tube in this position, the turret 28 is indexed one station and as soon as it begins to index, the rod 106 is freed from the cam 154 with the result that the clamp blocks 134 engage the mouth portion of the tube so as to clamp it relative to the mandrel assembly 26. Immediately thereafter, due to the shape of the cam track 96, the associated plunger 88 is moved radially outwardly with the mandrel 86 serving to stretch and flatten the bag bottom leaving the two upstanding triangular bottom portions 30, as previously described. As the then partially formed bag bottom moves in a clockwise direction, the plow 32 serves to flatten the triangular bottom portions 30 followed by the heat sealing at the twelve o'clock position, the cooling at the one o'clock position, followed by the heat sealing at the two o'clock position and further cooling at the three o'clock position. With respect to these heat sealing and cooling operations, it is to be noted that the heat sealing unit 34 is carried by a support arm 156 which is pivotally mounted on a shaft 158 carried by the wall 54. Also pivotally mounted on the shaft 158 is a support arm 160 which carries the cooling unit 36. It is to be understood that the heat sealing unit 34 and the cooling unit 36 are moved away from the paths of the mandrel assemblies 26 during the indexing of the turret 28. Pivoting of the support arms 156 and 160 is accomplished by a mechanism which in and of itself is not a part of this invention.

In a like manner, the heat sealing unit 38 is carried by a support arm 162 which is mounted on a pivot shaft 164. The same pivot shaft 164 carries a support arm 166 for the cooling unit 40.

After the bag bottom has been completed, the then formed open end bag B is complete as it passes from the three o'clock position towards the four o'clock position. However, at the three o'clock position, the side seam of the bag is disposed lowermost whereas for proper orientation after filling for closing of the bag by a sealing operation, it is necessary that the side seam be facing the wall 54. This is the purpose of the bag rotating and orienting mechanism 42.

Referring now to FIGS. 7–12, it will be seen that there are two of the devices 42. The devices are identical and are carried by a support member 168 which projects from and is rigidly secured to the wall 54 by means of suitable bolts 170. The support member 168 has a pair of flanges 172 projecting from one side thereof.

The support 168, as is best shown in FIG. 9, has secured to the underside thereof a mounting block 174 for each of the devices 42. The mounting blocks 174 are secured to the support 168 by bolts 176.

Each mounting block 174 has mounted therein a bushing 178 for its respective device 42. The bushing 178 has rotatably journaled therein a tubular shaft 180 which carries at the opposite sides thereof a pair of lugs 182, as is best shown in FIG. 12. Each lug 182 carries a pivot pin 184 on which there is pivotally mounted a U-shaped portion 186 of a clamp arm 188. The opposite end of each clamp arm 188 is generally planar and carries a clamp block 190 having a clamping surface 192 which is complementary to the outer surface of the inner mandrel 84. The clamp blocks 190 are removably secured to the clamp arms 188 by bolts 194.

Central portions of the clamp arms 188 carry cam blocks 196 disposed in opposed relation. Further, central portions of the clamp arms 188 are drawn together by tension springs 198. The springs 198 serve to normally urge the clamp blocks 190 together to clamp a newly formed bag onto the inner mandrel 84.

In order that the clamp blocks 190 may be spread apart, there is provided a plunger 200 which carries a cam 202 engageable with the cams 196. When the cam 202 is in its retracted position, the clamp blocks 190 are operative. When the cam 202 is extended, as is shown in FIG. 12, the clamp blocks 190 are separated and are in their released position. This is the normal position of the clamp arms 188.

Figure 8:
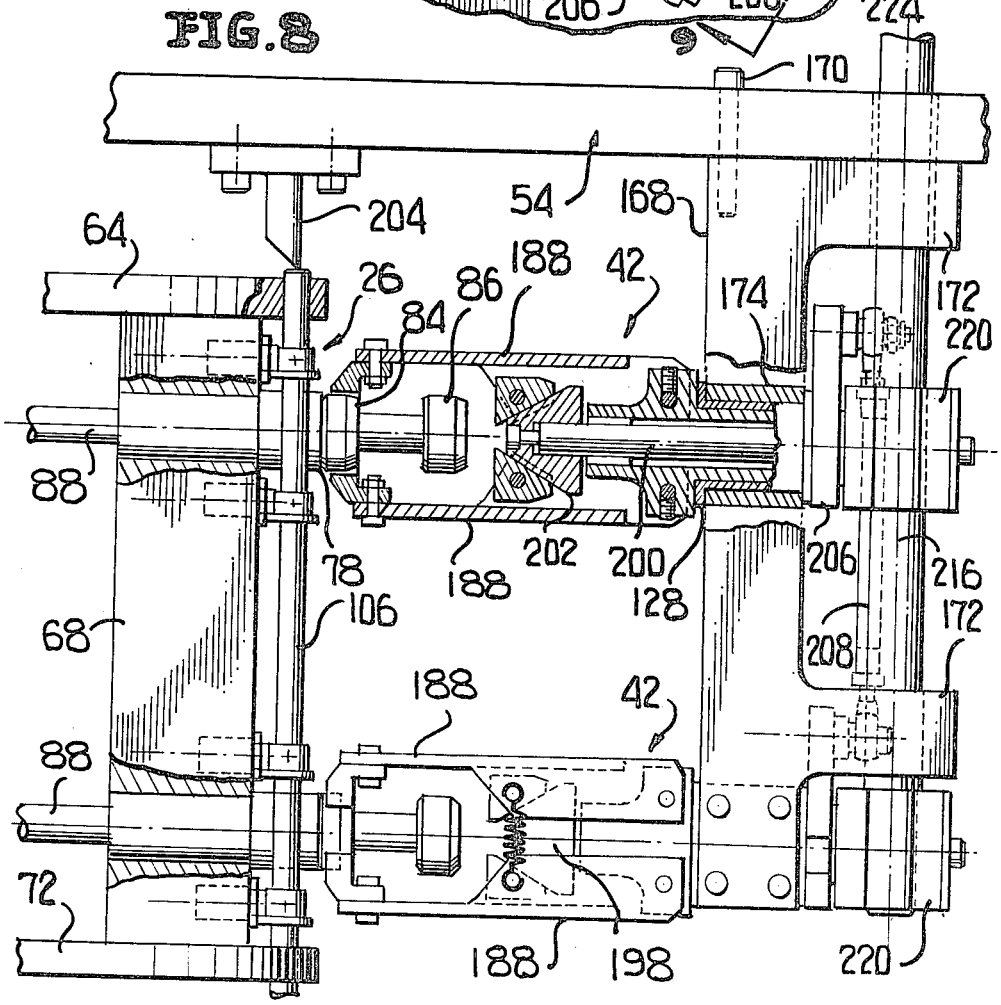
FIG. 8 is an enlarged fragmentary generally horizontal sectional view taken generally along the line 8—8 of FIG. 7 and shows the specific means for clamping a bag having its bottom shaped and rotating the bag and the mandrels through a ninety degree turn.

It is to be noted from FIG. 8, for example, that when the turret 28 is indexed, the axis of each device 42 is aligned with the axis of the its associated mandrel assembly 26. It is also to be noted that there is a cam 204 carried by the wall 54 which is then engaged by the rod 106 so as to release the clamp mechanism clamping the bag to the mandrel sleeve 78. The bag is now ready to be rotated ninety degrees. To this end, each sleeve 180 has mounted on the outer end thereof a crank arm 206. The two crank arms 206 are connected together by a link 208 for movement in unison. The crank arm 206 which is disposed remote from the wall 54 also has connected thereto an actuating link 210. The actuating link 210 is coupled to the forward end of a plunger 212 which is mounted for axial movement in a sleeve type support 214 carried by the wall 54 and which extends through the wall 54, as is clearly shown in FIG. 10.

Figure 7:
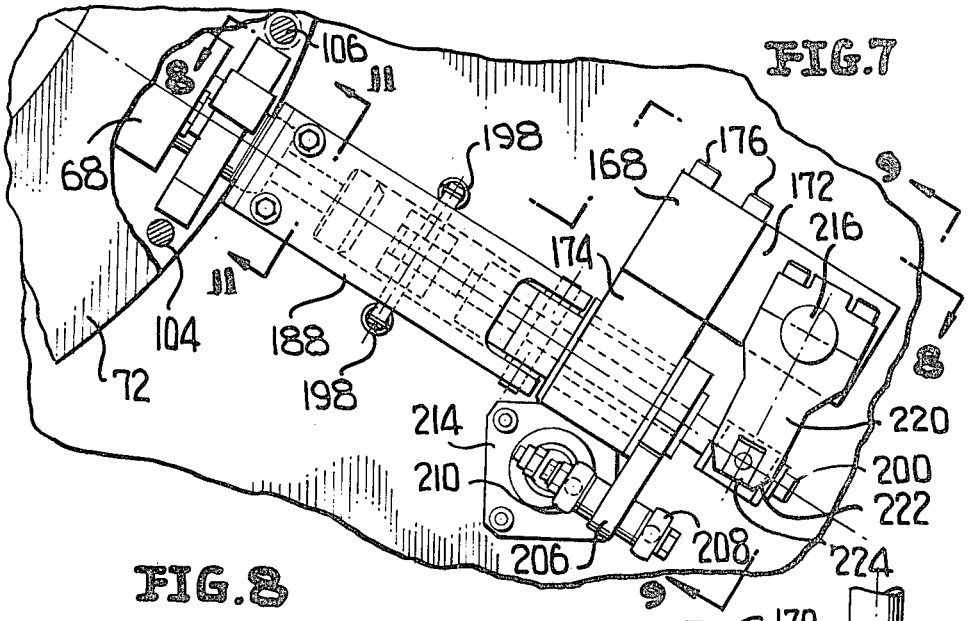
FIG. 7 is an enlarged fragmentary elevational view showing the bag rotating means at the four o'clock position of the turret.

However, before the devices 42 can be rotated, it is necessary that the cams 202 be retracted so that the clamp blocks 190 may clamp the inner portions of the bag to the inner mandrel 84. This is accomplished by moving each plunger 200 along the axis thereof. To this end, there is rotatably journaled in the flanges 172 a shaft 216 which extends through the wall 54 and has connected to the rear end thereof a crank 218 to effect rotation thereof. The crank 216 carries a pair of crank arms 220 which have bifurcated portions 222 engaging pivotally mounted blocks 224 carried by the plunger 200, as is best shown in FIG. 7. When the shaft 216 is rotated, the plungers 200 are withdrawn, withdrawing the cams 202 and permitting the clamp arms 188 to move together in response to the urging of the springs 198. The bag is thus gripped to the inner mandrel 84 for rotation by the respective device 42 together with the respective mandrels 84, 86.

Figure 13:
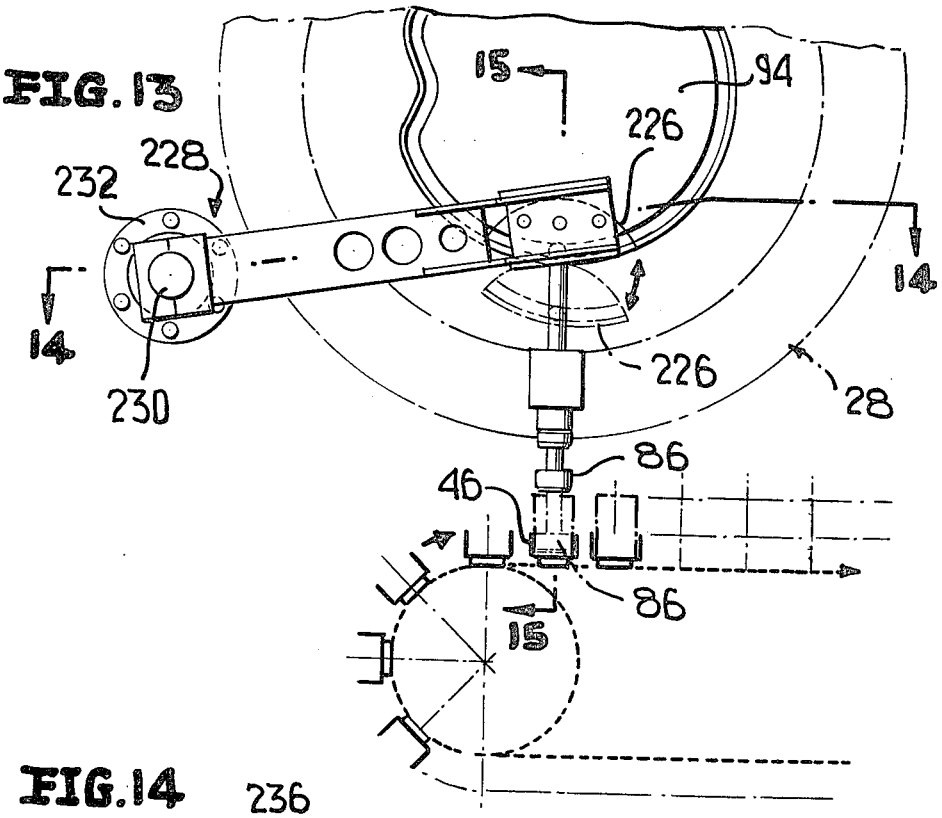
FIG. 13 is an enlarged fragmentary schematic elevational view showing the manner in which a segment of the cam for one of the outer mandrel supports is movable away from the remainder of the cam by means of a rocker arm so as to provide for the necessary stroke to discharge a formed bag into a take-away conveyor pocket.

After each bag has been oriented, it is now ready for discharge from the turret 28 into one of the pockets 44 of the conveyor 46. This is accomplished by radially outwardly projecting the outer mandrel 86 down into the underlying aligned pocket 44, as shown in phantom lines in FIG. 13. However, the cams 94 are not sufficiently large so as to have a stroke which will enable this movement of the outer mandrel 86. Accordingly, as is best illustrated in FIG. 13, each cam 94 has a lowermost cam segment 226 which is downwardly displaceable as shown in phantom lines in FIG. 13. The cam segments 226 are carried by a rocker arm assembly which is generally identified by the numeral 228 for movement from their positions forming parts of the cams 94 and the downwardly shift of positions shown in dotted lines in FIG. 13.

Figure 14:
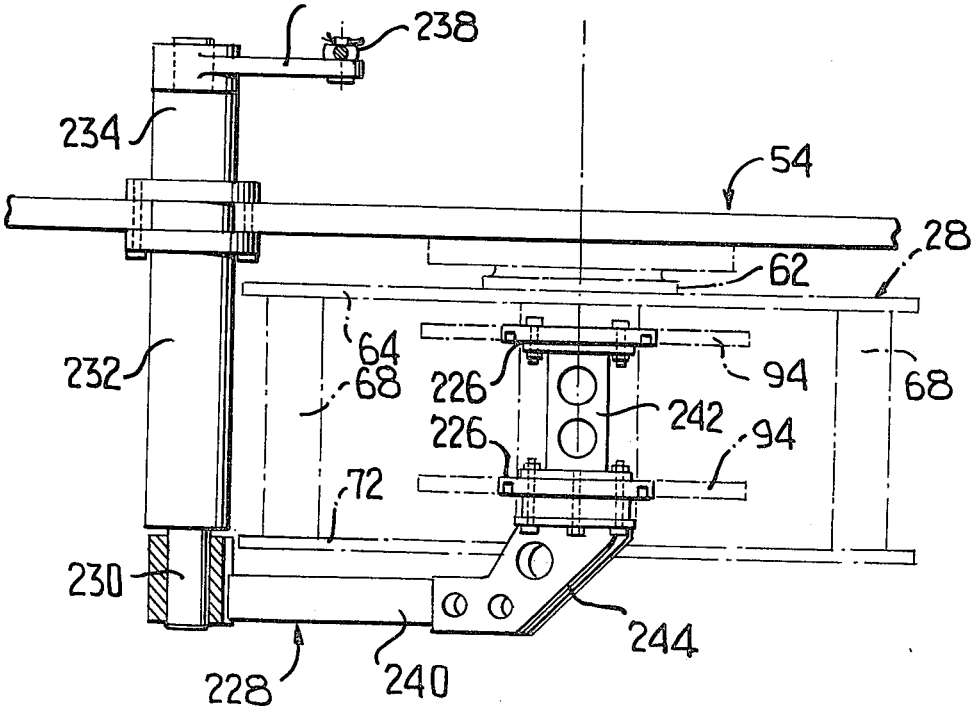
FIG. 14 is an enlarged fragmentary horizontal sectional view taken generally along the line 14—14 of FIG. 13 and shows more specifically the details of the mounting of the rocker arm for simultaneously moving downwardly two segments of the two control cams.
Figure 15:
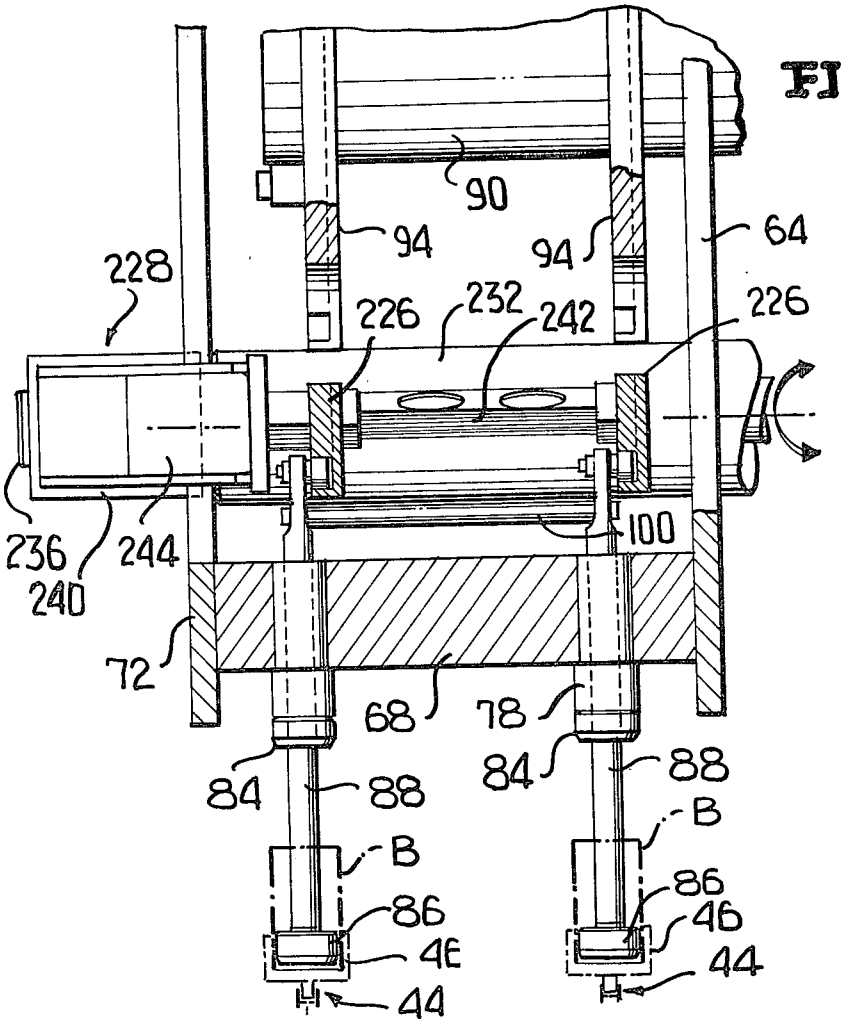
FIG. 15 is an enlarged fragmentary vertical sectional view taken along the line 15—15 of FIG. 13 and shows more specifically the movement of the cam segment so as to effect the discharge of the formed bags.

The rocker arm assembly 228, as is best shown in FIG. 14, includes a shaft 230 which is carried by sleeve like supports 232 and 234 secured to and extending from opposite sides of the wall 54. The rear end of the shaft 230 is provided with a crank arm 236 which has coupled thereto an actuating link 238 which is vertically reciprocated in timed relation to the indexing of the turret 28 by a mechanism which in of itself does not form part of this invention.

The rocker arm assembly 228 includes an arm 240 which extends from the shaft 230 at the front of the turret 28 and includes a support portion 242 carried by an angle bracket arrangement 244. The support portion 242 has fixedly secured thereto the cam segments 226 for movement therewith.

Figure 16:
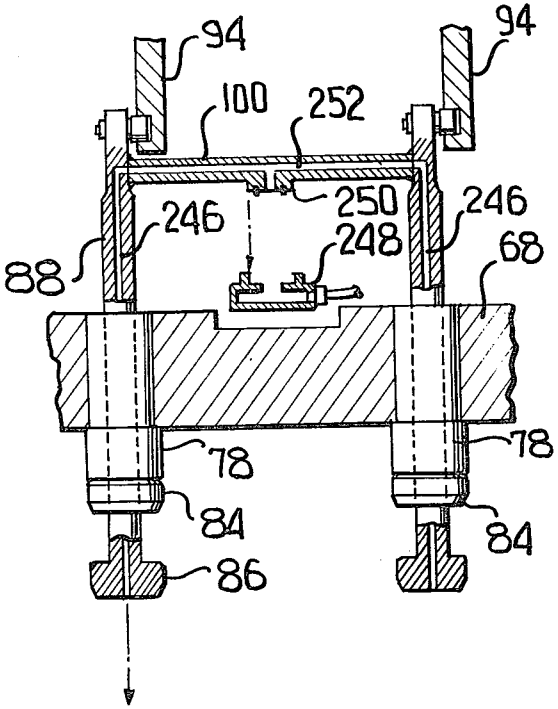
FIG. 16 is an enlarged fragmentary vertical sectional view showing one form of manifold means for effecting the direction of air under pressure through the outer mandrel supports so as to assure discharge of the formed bags from the outer mandrels.

It will be readily apparent that when the rocker arm assembly 228 is actuated to move the arm 240 in a downward direction, as viewed in FIG. 13, the cam segments 226 will be moved downwardly therewith so as to move the plungers 88 downwardly sufficiently to position the mandrels 86 in the pockets 44 of the conveyors. The bags B may engage in the pockets 44 with such a friction fit so that when the mandrels 86 are withdrawn, the bags B will remain in the pockets 46. On the other hand, if it is necessary, the plungers 88 may be hollow so as to have a compressed air passage 246 extending therethrough, as is best shown in FIG. 16. The compressed air passages 246 will open at the outer ends of the mandrels 86 and compressed air may be directed therethrough so as to force the bags B off of the mandrels 86 while they are within the pockets 44.

Any type of air supply may be provided. A simple manner of providing the necessary air would be providing a fixed manifold 248 and providing the cross bar 100 with plug portions 250 which are engageable with the manifold 248 in generally sealed relation to receive air therefrom in timed relation. The cross bars 100 may be provided with air passages 252 which open into the air passages 246.

Returning once again to FIG. 2, it is to be noted that there is carried by the wall 54 a further clamp release cam 254 which is positioned to be engaged by the rod 106 when the mandrel assembly 26 in question is at the six o'clock position. Thus the clamp assemblies 102 associated with the mandrel assemblies 26 are released at the time when the mandrels 86 are projected to discharge the formed bags.

At this time it is pointed out that the illustrated and described portions of the machine 20 are only parts of that machine. As described above, the turret 28 is indexed at regular intervals. After each indexing of the turret, other drive mechanisms which operate in timed relation to the indexing of the turret serve to drive the accessories to effect the necessary heat sealing, cooling, bag orientation and bag discharge. Inasmuch as the drive for the accessories may be of any conventional type, no attempt has been made here to specifically illustrate the details of that drive.

Although only a preferred embodiment of the invention has been specifically illustrated and described herein, it is to be understood that minor variations may be made in the machine without departing from the spirit and scope of the invention as defined by the appended claims.

I claim:

1. An apparatus for shaping a sealed tube bottom into a flat bag bottom and delivering the shaped bag to take-away means, said apparatus comprising a turret, means mounting said turret for indexing movement about a fixed generally horizontal axis, said turret having a plurality of stations, each of said stations including a mandrel assembly, each mandrel assembly including an inner mandrel, and an outer mandrel, a plunger for each outer mandrel and extending into the interior of said turret through said inner mandrel, and cam means cooperating with an inner end of said plunger for positioning said outer mandrel relative to said inner mandrel, and orienting means for engaging the bag while on said mandrel assembly and rotating the bag about the axis of said mandrel assembly.

2. Apparatus according to claim 1 wherein said orienting means includes a partible clamp device, spreader means for spreading said clamp device to permit sidewise movement of a bag into the confines of said clamp device, and means for rotating said clamp device about the axis of the mandrel assembly then aligned with said clamp device.

3. Apparatus according to claim 2 wherein said clamp device includes two clamp arms, and means pivotally mounting said clamp arms on a carrier remote from said turret for opening movement of said clamp arms, and spreader means for opening said clamp arms.

4. Apparatus according to claim 3 wherein said spreader means includes a rod slidably carried by said carrier and carrying a wedge member for effecting wedging apart of said clamp arms.

5. Apparatus according to claim 4 wherein said rotating means for rotating said clamp arms includes means mounting said carrier for rotation about a fixed axis, and crank means connected to said carrier for effecting rotation thereof about said fixed axis.

6. Apparatus according to claim 2 together with means for actuating said wedge member and said crank means in timed relation to each other and to the indexing of said turret.

7. Apparatus according to claim 2 wherein said rotating means for rotating said clamp arms includes means mounting said carrier for rotation about a fixed axis, and crank means connected to said carrier for effecting rotation thereof about said fixed axis.

8. An apparatus for shaping a sealed tube bottom into a flat bag bottom and delivering the shaped bag to take-away means, said apparatus comprising a turret, means mounting said turret for indexing movement about a fixed generally horizontal axis, said turret having a plurality of stations, each of said stations including a mandrel assembly, each mandrel assembly including an inner mandrel, and an outer mandrel, a plunger for each outer mandrel and extending into the interior of said turret through said inner mandrel, and cam means cooperating with an inner end of said plunger for positioning said outer mandrel relative to said inner mandrel, said cam including a discharge portion in the form of a separately formed cam segment, and means for moving said cam segment radially away from the remainder of said cam to project said outer mandrel to a greatly projected discharge position.

9. Apparatus according to claim 3 wherein said means for moving said cam segment is a rocker arm carried by a shaft disposed generally parallel to the axis of said turret.

10. An apparatus for shaping a sealed tube bottom into a flat bag bottom and delivering the shaped bag to take-away means, said apparatus comprising a turret, means mounting said turret for indexing movement about a fixed generally horizontally axis, said turret having a plurality of stations, each of said stations including a mandrel assembly, each mandrel assembly including an inner mandrel, and an outer mandrel, a plunger for each outer mandrel and extending into the interior of said turret through said inner mandrel, and cam means cooperating with an inner end of said plunger for positioning said outer mandrel relative to said inner mandrel, clamp means for clamping a tube to each mandrel assembly and restraining the tube against radial outward movement, each mandrel assembly including a fixed mandrel portion adjacent said inner mandrel, and said clamp means being cooperable with said fixed mandrel portion.

11. Apparatus according to claim 10 wherein said outer mandrel is mounted for rotation on said plunger and said inner mandrel is mounted for rotation relative to said fixed mandrel portion.

12. Apparatus according to claim 10 wherein said clamp means includes at least one clamp arm, a pivot mounted centrally of said clamp arm mounting said clamp arm for pivotal movement, a clamp surface opposing said fixed mandrel portion carried by said clamp arm in off center relation, spring means engaging one end portion of said clamp arm for normally urging said clamp surface towards said fixed mandrel portion, and actuator means engaging the opposite end of said clamp arm for selectively overcoming the urging of said spring means.

13. Apparatus according to claim 12 wherein said spring means and said actuator means are carried by spaced parallel rods, and said parallel rod carrying said actuator means being axially shiftable to release said clamp means against the urging of said spring means.

14. Apparatus according to claim 13 wherein there are two of said clamp arms, one on opposite sides of said mandrel assembly, and said clamp surfaces being in diametrically opposite relation.

15. Apparatus according to claim 14 wherein said clamp arms are identical, but reversely oriented.

16. Apparatus according to claim 13 wherein said turret means includes a pair of plates separated by plural spacer blocks, each mandrel assembly being carried by one of said spacer blocks, each of said clamp arms being pivotally mounted of a respective spacer block, and said rods extending between said plates on opposite sides of a respective spacer block.

17. Apparatus according to claim 16 wherein each spacer block carries two of said mandrel assemblies in spaced relation between said plates.

18. Apparatus according to claim 16 wherein each spacer block carries two of said mandrel assemblies in spaced relation between said plates, there are separate clamp means for each mandrel assembly, and said spring means and said actuator means for said two clamp means are carried by the same rods.

19. An apparatus for shaping a sealed tube bottom into a flat bag bottom and delivering the shaped bag to take-away means, said apparatus comprising a turret, means mounting said turret for indexing movement about a fixed generally horizontal axis, said turret having a plurality of stations, each of said stations including a mandrel assembly, each mandrel assembly including an inner mandrel, and an outer mandrel, a plunger for each outer mandrel and extending into the interior of said turret through said inner mandrel, and cam means cooperating with an inner end of said plunger for positioning said outer mandrel relative to said inner mandrel, said apparatus including a main support in the form of a vertical wall separating said machine into a sanitary product handling half and a drive machinery half.

20. Apparatus according to claim 19 wherein said wall is of a hollow construction including a pair of face plates separated by structural elements.

* * * * *